US005906300A

United States Patent [19]

Horie

[11] Patent Number: 5,906,300

[45] Date of Patent: May 25, 1999

[54] DOUBLE WALL APPLICATOR

[75] Inventor: Takashi Horie, Dublin, Ohio

[73] Assignee: Toagosei America, Inc., West Jefferson, Ohio

[21] Appl. No.: 08/971,500

[22] Filed: Nov. 17, 1997

[51] Int. Cl.[6] ..... B65D 37/00; B65D 47/18

[52] U.S. Cl. ..... 222/214; 222/420

[58] Field of Search ..... 222/206, 214, 222/215, 420

[56] References Cited

U.S. PATENT DOCUMENTS

| | | | |
|---|---|---|---|
| 3,366,284 | 1/1968 | Marona et al. | 222/215 X |
| 4,324,348 | 4/1982 | Johnson et al. | 222/214 X |
| 5,261,571 | 11/1993 | Goncalves | 222/214 |
| 5,494,198 | 2/1996 | Heiberger | 222/215 X |
| 5,529,217 | 6/1996 | Siegel | 222/214 X |

*Primary Examiner*—Andres Kashnikow

*Assistant Examiner*—Sean P. O'Hanlon

*Attorney, Agent, or Firm*—George P. Maskas

[57] ABSTRACT

An applicator of resilient plastic material having a double wall construction, an air chamber between the walls and spacers in the air chamber is disclosed. The applicator is adapted to be pressed between the thumb and forefinger to dispense glue. The applicator has an applicator body comprising a shoulder, a dispensing opening in the shoulder and a downwardly depending skirt. A cup which is adapted to hold glue, particularly cyanoacrylate glue, is within the skirt and the top and bottom portions of the cup are in fluid tight engagement with the applicator body adjacent the top and bottom of the skirt. The cup fits within the skirt with its walls in spaced apart relationship with the skirt to provide an air chamber therebetween. The shape of cup walls and the opposed skirt generally conform to each other. A preferred embodiment includes friction elements on the outside of the skirt overlying at least a portion of the area covered by the spacers.

16 Claims, 5 Drawing Sheets

DOUBLE WALL APPLICATOR

BACKGROUND OF THE INVENTION

1. Field of the Invention

This invention relates to applicators for glue or the like. In particular, this invention relates to a two piece applicator which is injection molded from resilient material and which is particularly suited for applying substances such as cyanoacrylate adhesive. Such applicators must be capable of accurately dispensing minute quantities of glue in precise locations. The applicator has a double wall construction with an air chamber between the walls. The double wall construction inhibits moisture and light from coming into contact with the adhesive. The air chamber assists in the dispensation of glue in a carefully metered drop-wise form which is easily controlled.

2. Description of Related Art

Prior art applicators for adhesives such as cyanoacrylate are subject to a number of problems. Such applicators are generally constructed of plastic material or thin metal such as aluminum in the form of tubes. Metal tubes are often cumbersome and it is difficult to control the drop-wise application of the glue. Plastic material is generally adversely affected by light and moisture and again many such applicators have difficulty in accurately and easily dispensing glue in a controlled manner.

The instant invention solves the above mentioned shortcomings of the prior art by providing an applicator constructed of resilient material wherein the sides of the applicator have a spaced apart double wall construction with an air chamber between the two walls. The double wall inhibits the amount of moisture and light which penetrates into the adhesive from the sides of the applicator. Also, the air chamber acts as a pneumatic cushion which enables fine control of the amount of glue dispensed. Spacers separate the inner and outer walls of the air chamber. The spacers are generally oriented vertically and placed in a location where the pinching action on the outer applicator body in dispensing adhesive by actuation between the thumb and forefinger places pressure on the spacer which in turn distributes the pressure over a large area of the inner container which holds the glue.

The applicator is preferably molded from resilient plastic material, e.g., resilient thermoplastic polymeric material such as high density polyethylene or polypropylene.

In a preferred embodiment, the applicator is molded in two parts. The applicator comprises an applicator body having a downwardly depending skirt with a shoulder adjacent its top, an applicator opening in the shoulder and a nozzle in fluid communication with the applicator opening. The applicator also comprises an inner container or cup which is fitted within the skirt of the applicator body with the cup opening in fluid communication with the applicator body opening. The inner side of the shoulder and the top of the inner side of the skirt have resilient locking means such as a resilient slot therebetween as well as peripheral beads and grooves for engaging cooperating resilient locking means at the top of the cup. The bottom of the cup and the skirt also have resilient locking means for holding the two parts together. There is general conformity in the shape of the walls of the cup with the opposed walls of the skirt along a major portion of the cup walls. The distance (space) between the walls of the skirt and the cup is substantially the same, in a horizontal plane, about the periphery of the cup walls and the skirt along a major portion of the cup walls. The skirt and cup are proportioned so that the inner sides of the skirt and the outer sides of the cup walls are separated by an air space and cooperative resilient locking means adjacent the top and bottom of the cup in cooperation with resilient locking means adjacent the top and bottom of the skirt form a fluid tight air chamber therebetween.

The cup also has at least one rib molded on its walls toward the skirt which extends from adjacent the bottom of the cup walls upwardly toward the top of the cup. The thickness of the rib acts as a separator to keep the sides of the skirt from contacting the sides of the cup walls. The sides of the applicator skirt are typically very smooth. To prevent slippage of the applicator, the outer side of the skirt has a friction area such as a series of raised elements which are in the general area opposite the cup rib. The raised elements on the outer surface of the skirt form a friction area over which the applicator is pinched or squeezed to cause pressure and inward flexing of the skirt. The flexing of the skirt transfers pressure to the spacer ribs of the cup and the air chamber which acts as a pneumatic cushion and which in turn cause an inward flexing action of the cup walls in order to dispense glue through the opening of the applicator body and through the elongated nozzle. The pneumatic cushion provides for better control in dispensing the glue in a metered and drop-wise manner.

The friction area on the outer side of the skirt will generally overlie the cup rib so that the pressure from the pinching or squeezing of the skirt is transferred to the cup by the rib. In a preferred embodiment, a vertical rib is on two of the opposite sides of the cup in substantial alignment with each other in a vertical plane. The skirt will also have friction areas on opposite sides of the skirt so that when the applicator is pinched in the friction areas the pressure is transferred to each of the cup ribs which act opposite to each other to transfer pressure and a flexing action to the cup.

By the term "resilient locking means" is meant locking or attaching means which depend on the resiliency of the members involved, e.g., wherein one member is forced within opposed walls of another to hold the members in place or wherein one member fits tightly about the inside or outside periphery of another. "Snap-locking means" are resilient detent means such as peripheral grooves and beads, portions of a groove or indentation or portions of a bead or raised surface which have resilient properties and permit the snapping in of a male part, e.g., a bead, with a female part, e.g., a groove, to hold two articles in place. It should be noted that only one member of the resilient locking means or the snap-locking means needs to be resilient. In addition to resilient locking means, other locking means can be used in this invention such as heat sealing or otherwise adhering the applicator body skirt adjacent to the bottom of the cup after the cup has been placed within the skirt.

The embodiments of the invention shown here are intended to enable the best mode of the invention that is known to the inventor. They should be taken as illustrative and not limiting and the scope of the invention should be limited only by the scope of the appended claims and their equivalents.

SUMMARY OF THE INVENTION

In one aspect, this invention relates to an applicator of resilient material comprising:

(a) an applicator body with an opening adjacent the top thereof, said applicator body having an annular skirt depending downwardly below the applicator opening;

(b) a cup within the annular skirt, said cup adapted to contain liquid which communicates with the applicator opening and is attached within the skirt in fluid tight engagement adjacent the top and bottom of the cup, the sides of the skirt and the walls of the cup are spaced apart so as to provide an air chamber therebetween and a spacer is provided within the air chamber.

In another aspect, this invention relates to an applicator of resilient plastic material comprising:

(a) a vertically elongated elliptical applicator body having a shoulder with a dispensing opening and a nozzle adapted for drop-wise application of adhesive in fluid communication with the dispensing opening. A skirt depends downwardly from the shoulder. Resilient means such as resilient locking means are located adjacent and within the top of the applicator body such as wherein the skirt has peripheral snap-locking means inside of the skirt opposite a downwardly descending flange on the inner side of the shoulder so as to leave a substantially uniform space therebetween wherein the flange generally follows the shape of the skirt outwardly thereof and peripheral resilient locking means adjacent the bottom of the skirt; and (b) an elliptical cup fitted within the skirt with its open end facing upwardly in fluid communication with the applicator opening and the walls of the cup adjacent the top open end adapted to fit within the space between the skirt wall and the downwardly depending flange below the shoulder in resilient locking engagement with the applicator body. The bottom of the cup has resilient locking means for cooperative attachment with the resilient locking means at the bottom of the skirt and wherein the sides of the cup and the sides of the skirt between the resilient locking means are spaced apart to provide for an air chamber. The configuration of the opposed side walls of the cup and the skirt in the horizontal plane are generally in conformity with each other and a verticle spacer is provided within the air chamber to keep the opposed walls of the chamber from coming in contact with each other.

Additional aspects of this invention relate to preferred configurations of the applicator and preferred positioning of the spacers and friction elements. In one preferred embodiment, the air chamber has two spacers in substantially diametrically opposed sides of the applicator.

Not shown in the drawings, the applicator of this invention will normally have an elongated cap which has screw threads which cooperate with screw threads adjacent the bottom of the nozzle to form a fluid seal. Also, the inside of such cap has a top which abuts across the top of the nozzle to seal off the nozzle opening.

DETAILED DESCRIPTION OF THE PREFERRED EMBODIMENTS

Figure 2:
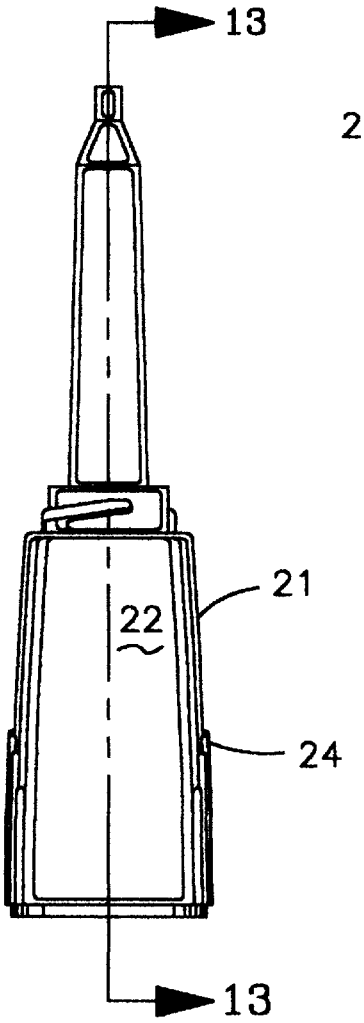
FIG. 2 is a side elevation view of the applicator.
Figure 4:
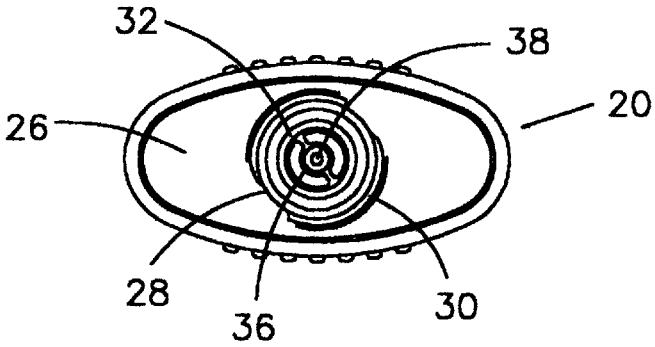
FIG. 4 is a top plan view of the applicator.
Figure 3:
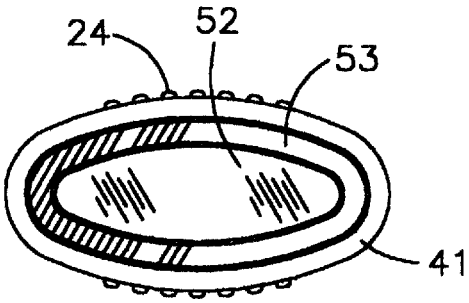
FIG. 3 is a bottom plan view of the applicator.
Figure 1:
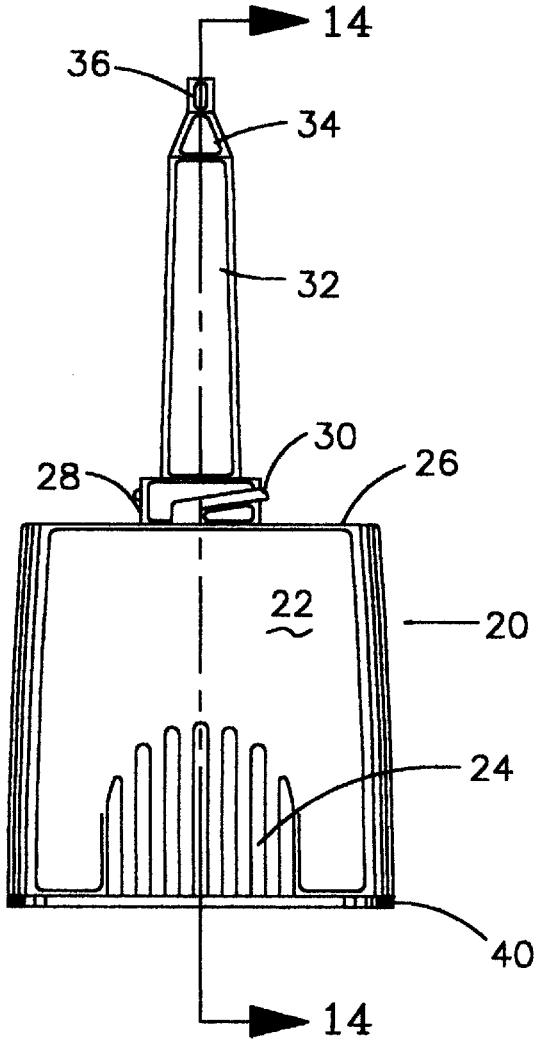
FIG. 1 is a front elevation view of the applicator.

Referring now to the drawings wherein identical numerals refer to identical parts and particularly to FIGS. 1–4, there is shown an elongated elliptical applicator 20 molded of a resilient plastic material. The applicator includes applicator body 21 having an elliptical skirt 22, friction elements in the form of raised ribs 24 in the central lower portion of the relatively flat side of skirt 22, a shoulder 26, an annular flange 28 having screw threads 30 thereon, and a nozzle 32 having its bottom portion inwardly of annular flange 28 and which tapers inwardly adjacent the top to form cone 34 which terminates with tube element 36 having applicator opening 38. Below skirt 22 there is shown peripheral bottom flange 40 of cup 42 which is more fully described in FIGS. 9–12. A model of the applicator shown in FIGS. 1–4 which fits comfortably between the thumb and forefinger for applying pressure to the opposed friction elements 24 on flat sides of skirt 22 has a thickness (the short axis of the ellipse) of 0.72 inches (1.8 cm), a width (across the long axis of the ellipse, also referred to as the flat side) of 1.34 inches (3.4 cm) and a height from the bottom of the applicator to the top of the nozzle opening of 2.91 inches (7.3 cm).

Figure 8:
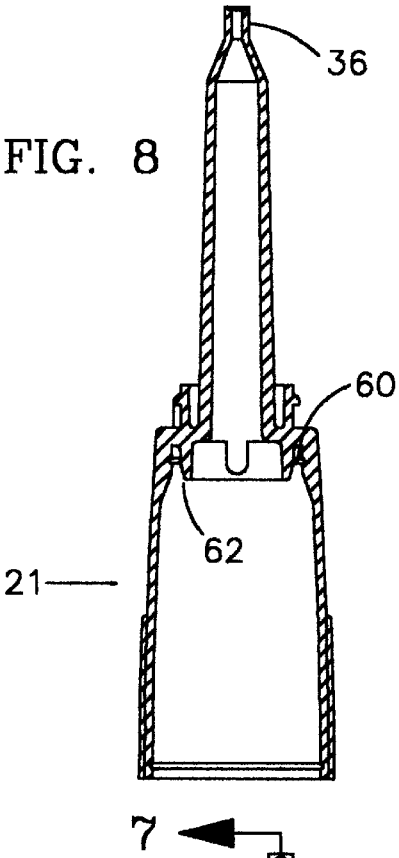
FIG. 8 is a vertical cross-section taken on the line 8—8 of the applicator body as shown in FIG. 5.
Figure 7:
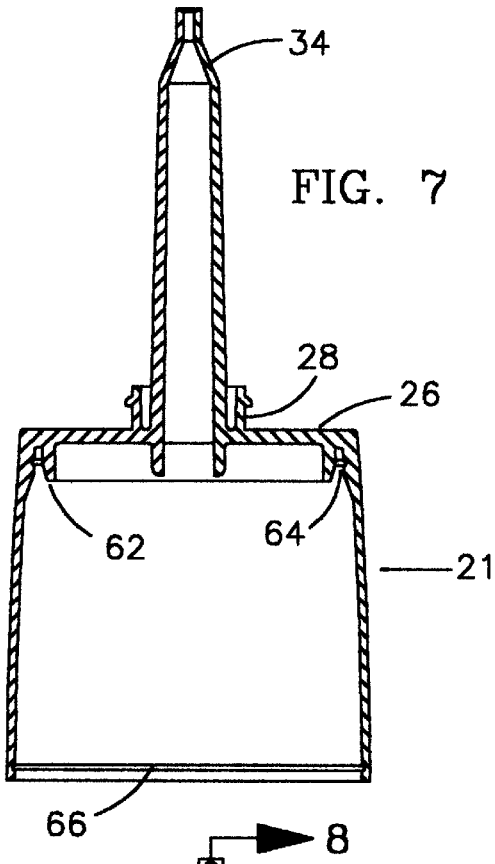
FIG. 7 is a vertical cross-section taken on the line 7—7 as shown in FIG. 6.
Figure 6:
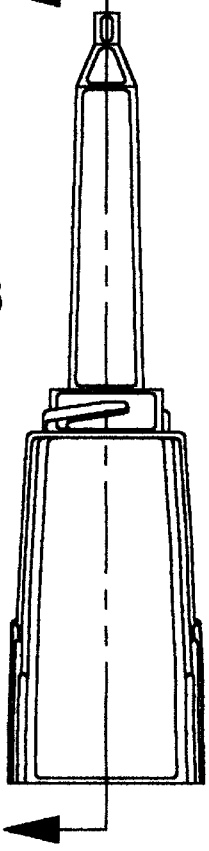
FIG. 6 is a side elevation view of the applicator body.
Figure 5:
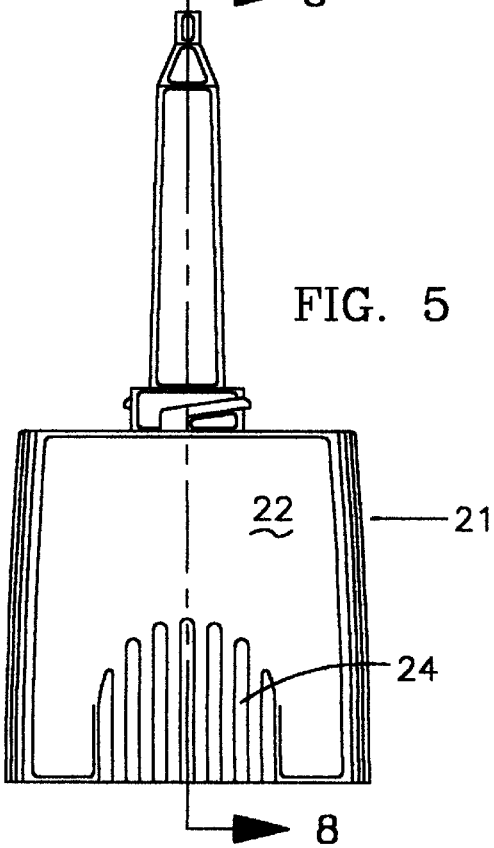
FIG. 5 is a front elevation view of the applicator body.
Figure 12:
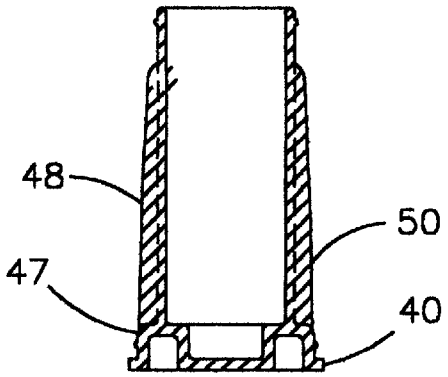
FIG. 12 is a vertical cross-section on the line 12—12 of the cup as shown in FIG. 9.
Figure 11:
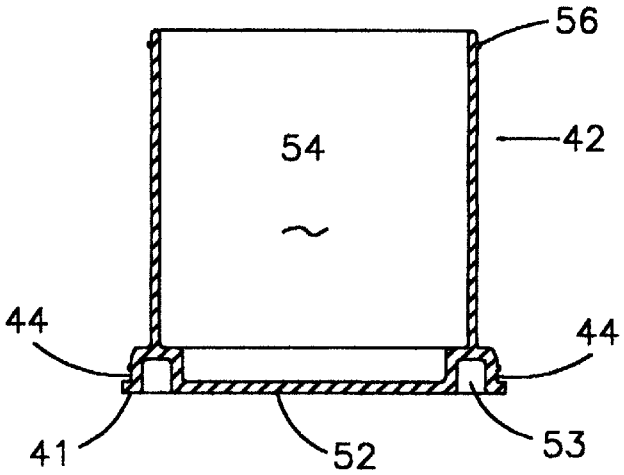
FIG. 11 is a vertical cross-section of the cup taken on line 11—11 as shown in FIG. 10.
Figure 10:
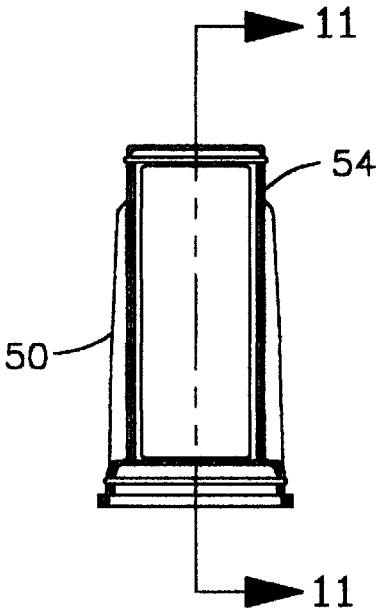
FIG. 10 is a side elevation view of the cup.
Figure 9:
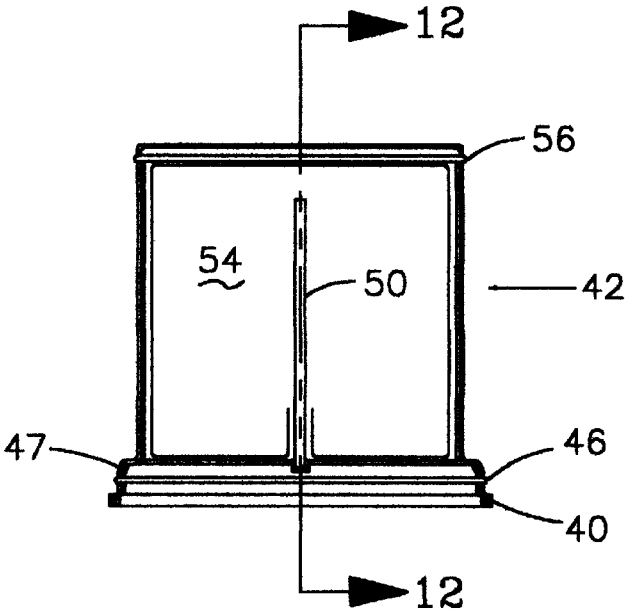
FIG. 9 is a front elevation view of the cup which fits within the applicator body.
Figure 13:
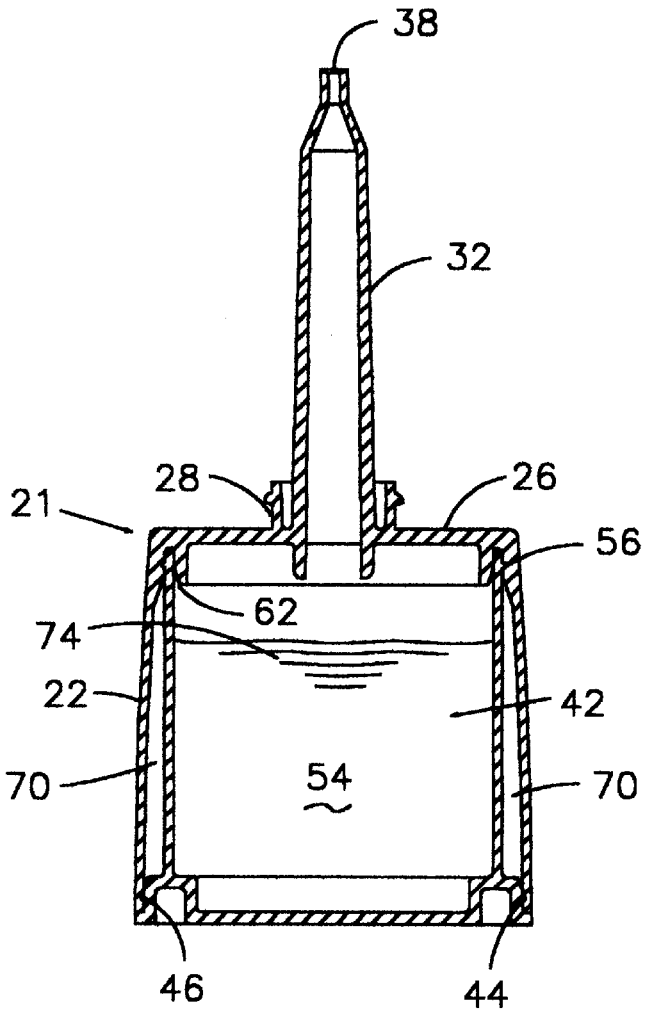
FIG. 13 is a vertical cross-section taken on line 13—13 as shown in FIG. 2 of the applicator wherein the cup containing liquid glue is fitted and snap-locked within the applicator body.
Figure 14:
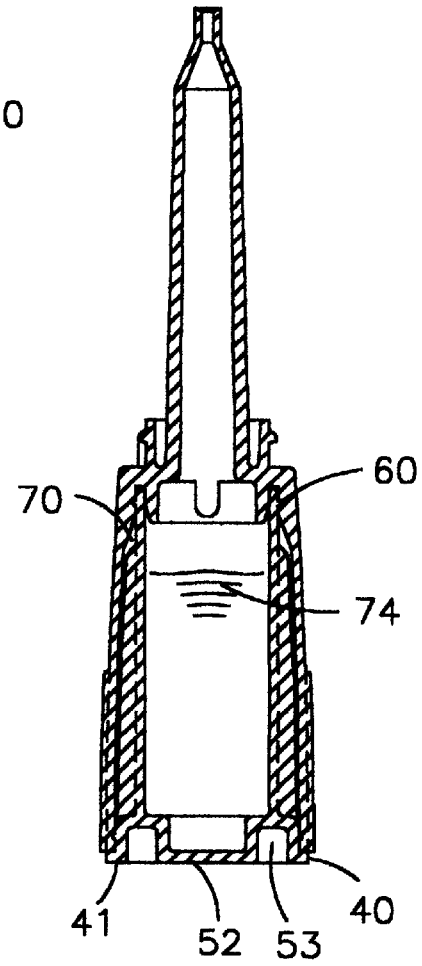
FIG. 14 is a vertical cross-section of the applicator taken on line 14—14 as shown in FIG. 1.
Figure 15:
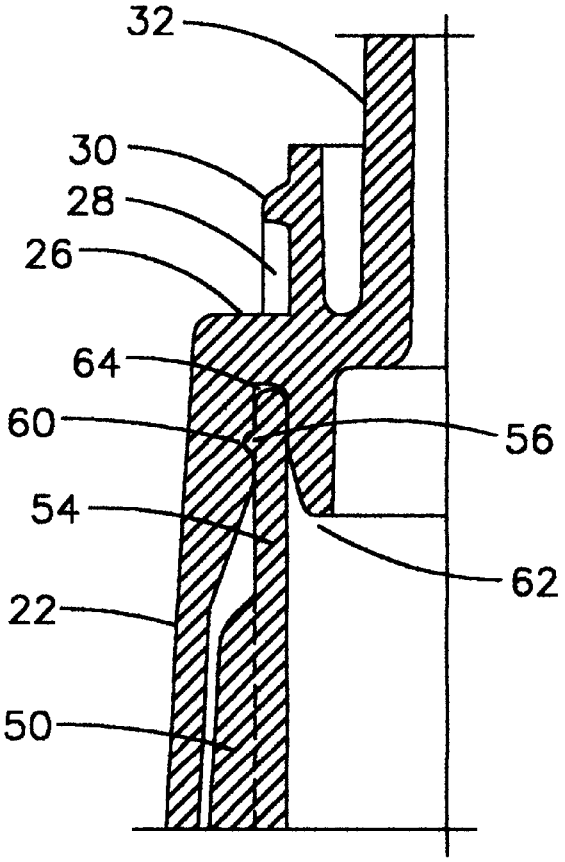
FIG. 15 is partial, expanded, vertical cross-section of FIG. 13 showing the top of the cup walls snap-locked within the top inner side of the applicator body.
Figure 16:
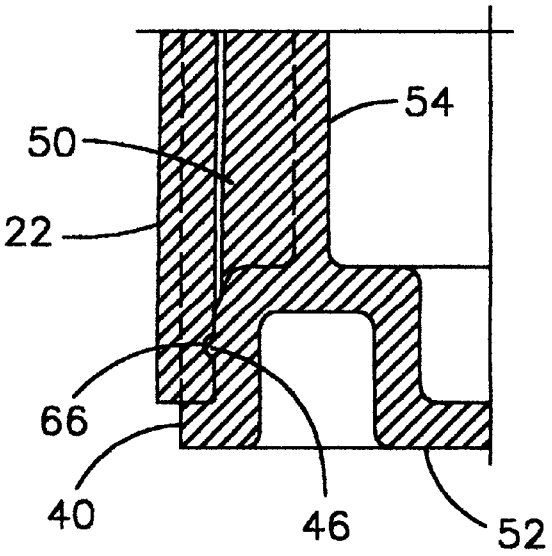
FIG. 16 is a partial, expanded, vertical cross-section of FIG. 14 showing the bottom of the applicator body snap-locked adjacent the bottom of the cup.

As shown particularly in FIGS. 7, 8, and 15, the inner side of the skirt 22 adjacent its top has a peripheral groove 60 and the cup walls adjacent their top have peripheral bead 56. The inner side of the shoulder 26 has a flange 62 depending downwardly therefrom whereby a space 64 is provided between downwardly depending flange 62 and the opposed inner wall of skirt 22. Flange 62 has substantially the same shape in horizontal cross-section as the inside of opposed skirt 22. Space 64 is thus surrounded by resilient locking means of the flange 62 on one side thereof and the resilient skirt 22 on the other side so as to accept the top of cup 42 in fluid tight engagement with the cup wall bead 56 snap-locked within skirt groove 60.

Referring now to FIGS. 9–12, elliptical cup 42 has a peripheral bottom flange 40, peripheral groove 44, peripheral bead 46, outwardly extending molded vertical ribs 48 and 50 which are diametrically opposed from each other in the short axis of the ellipse and rise from adjacent the bottom of cup 42 over a major portion of the height of the walls 54 of cup 42. Ribs 48 and 50 are located at about the midpoint along the long axis of the elliptical cup 42. The cup 42 has a bottom 52, and elliptical walls 54 which extend above ribs 48 and 50. The cup 42 also has an outwardly extending peripheral snap-locking bead 56 adjacent the top of the cup 42. The walls 54 of cup 42 will be in general conformity with the shape of opposed skirt 22 but of generally smaller dimensions so that cup 42 fits within skirt 22 with a fluid tight air chamber 70 formed adjacent the top and bottom of cup walls 54 by the cooperating resilient locking means between cup 42 and the inside of opposed skirt 22.

Referring now to FIGS. 13–16 the applicator 20 is assembled by fitting cup 42 within applicator skirt 22 so that the top of walls 54 of cup 42 fit in fluid tight engagement within the annular space 64 between skirt 22 and flange 62 while peripheral bead 56 adjacent the top of the cup 42 walls 54 is snap-locked within inner peripheral groove 60 of skirt 22. The bottom of the skirt 22 is snap-locked within peripheral groove 44 of cup 42 below peripheral bead 46 of cup 42 wherein bead 46 snap-locks within peripheral groove 66 on the inner side adjacent to the bottom of skirt 22. The applicator contains glue 74 therein.

The inside diameter of skirt 22 below the top snap-locking means of skirt groove 60 and the cup walls bead 56 and above the bottom of cup walls 54 is larger than the outside diameter of cup walls 54 so that a fluid tight chamber 70 is formed between the cup walls 54 and skirt 22. The fluid tight chamber 70 acts as a pneumatic cushion when inwardly directed pressure is forced against skirt 22. Ribs 48 and 50 which rise a major vertical distance along cup walls 54 act as spacers for air chamber 70 between the cup walls 54 and the skirt 22. The ribs 48 and 50 also strengthen the cup walls 54 so that when force is applied, such as by pinching the applicator in the vicinity of friction elements 24, the force is distributed over a large area of the cup walls 54. Bottom 52 of cup 42 includes an inwardly depressed groove 53 of substantially the same shape in the horizontal plane as bottom peripheral flange 40 as well as the bottom side 41 of bottom peripheral flange 40.

The ribs 48 and 50 are molded on the exterior of cup walls 54 and are diametrically opposed to each other at about the midsection of the long horizontal axis of the cup walls 54 so that pressure, e.g., by pinching the walls of skirt 22 in the area of friction elements 24, is applied against both of the opposed ribs 48 and 50 and is transmitted to the walls 54 of the cup 42.

In operation, the applicator 20 preferably contains fluid glue 74 such as cyanoacrylate glue. The applicator 20 is held between the thumb and the forefinger with the thumb and forefinger applying pressure which produces a flexing action against the applicator skirt 22 in the area of friction elements 24. The pressure is transmitted to ribs 48 and 50 on walls 54 of cup 42 which causes compression and flexing of the walls 54. The pressure is evenly transmitted to the cup 42 by the opposed cup ribs 48 and 50 as well as by the cushioning effect of the air chamber 70. This in turn forces glue out of the cup 42 through nozzle 32 and eventually out of applicator orifice 38. The glue will generally be applied in drop-wise form. The long nozzle 32 and small nozzle opening 38 provide accurate positioning for the drops of fluid.

While skirt and cup having an oval or elliptical cross-section in the horizontal plane are shown in the figures, it is to be appreciated that other shapes of skirt and cup such as those having a circular, rectangular or square horizontal cross-section can be used. The shape of the cup walls and applicator skirt in a horizontal plane defining the air chamber will be generally the same.

What is claimed is:

1. An applicator of resilient material comprising:

(a) an applicator body with an opening adjacent the top thereof, said applicator body having a skirt depending downwardly below the applicator opening said skirt having resilient locking means adjacent the inside of the skirt top and adjacent the bottom of the skirt, said skirt being open at the bottom;

(b) a cup, within the skirt, said cup having resilient locking means adjacent the top and bottom thereof cooperating with the skirt locking means to provide fluid tight engagement between the top and bottom locking means with a major portion of the cup walls spaced apart from the skirt between the locking means so as to provide a fluid tight air chamber there between, the cup adapted to contain liquid which communicates with the applicator opening and wherein the interior of the cup is substantially entirely within the area of the skirt whereby the applicator can be assembled by fitting the cup upwardly within the open bottom of the skirt to engage the locking means.

2. The applicator of claim 1 wherein two spacers are provided within the air chamber and such spacers are vertical ribs positioned substantially on a vertical line between opposed sides of the cup facing the skirt.

3. The applicator of claim 2 wherein the spacers are molded on the outer sides of the cup walls.

4. The applicator of claim 2 wherein the outer side of the skirt has friction elements forming an area which overlie the spacer means.

5. The applicator of claim 1 wherein the applicator body has a shoulder with a generally elliptical or rectangular cross-section in the horizontal plane surrounding the applicator opening and a generally elliptical or rectangular applicator body skirt depending downwardly from the shoulder with the opposed walls of the cup and the skirt having generally the same shape along a major portion between the top and bottom of the air chamber.

6. The applicator of claim 1 wherein the applicator body has a nozzle at the top thereof in fluid communication with the applicator body opening.

7. A two piece applicator constructed of resilient plastic material comprising:

(a) a first piece comprising a homogeneously integral, injection molded hollow applicator body having a shoulder with an elongated nozzle providing a dispensing opening therein and a skirt depending downwardly from the shoulder said skirt having resilient locking means adjacent the inside of the skirt top and adjacent the bottom of the skirt;

(b) a second piece comprising a cup within the applicator body with the top of the cup in fluid communication with the dispensing opening, said cup having resilient locking means adjacent its top and its bottom for cooperating with the resilient locking means of the skirt and being in fluid tight engagement within the applicator body with a major portion of the walls of the cup within the applicator skirt;

(c) a major portion of the applicator skirt being spaced from the walls of the cup between the locking means to provide an air chamber there between and wherein there is a general conformity in the shape of the walls of the cup with the opposed walls of the skirt; and (d) said cup having two diametrically opposed vertical rib spacers molded on the outside of the cup walls and extending into the air chamber to inhibit the walls of the cup from contacting the skirt within said air chamber said spacers extending upwardly from adjacent the bottom of the cup along a major height of the cup.

8. The applicator of claim 7 wherein the cup walls have a horizontal cross-section about their periphery of substantially the same general shape as the skirt opposite the cup walls.

9. The applicator of claim 7 wherein the skirt has friction elements on its outside surfaces in an area overlying the spacers.

10. The applicator of claim 7 wherein the shoulder and skirt are of a generally rectangular or elliptical cross-section in the horizontal plane, the spacers are vertical ribs placed about midway on the long side of the rectangle or ellipse of the cup, the distance between the walls of the cup and the skirt is substantially the same in the horizontal plane about the periphery of the cup walls and the skirt between each spacer rib over a major portion of the cup walls between the top and bottom of said walls and the walls of the cup are entirely within the skirt.

11. The applicator of claim 7 wherein the bottom of the skirt is open and adapted to receive the cup.

12. An applicator of resilient plastic material comprising:

(a) a vertically elongated elliptical applicator body having a shoulder with a dispensing opening and a nozzle adapted for drop-wise application of adhesive in fluid communication with the dispensing opening, the applicator body having a skirt depending downwardly from said shoulder, said skirt having a bottom opening and resilient locking means adjacent the inside of the skirt top and adjacent the bottom of the skirt;

(b) an elliptical cup fitted within the skirt bottom opening with its open end facing upwardly and in fluid communication with the applicator opening and forming fluid tight engagement with the resilient locking means of the skirt top and bottom by cooperation of resilient locking means adjacent the top and bottom of the cup with the resilient locking means of the skirt and wherein the walls of the cup and the skirt provide for an air chamber there between.

13. The applicator of claim 12 wherein the resilient locking means include peripheral snap-locking means.

14. The applicator of claim 13 wherein the snap-locking means for fluid tight engagement adjacent the skirt top comprise a flange spaced apart from the skirt depending downwardly from the shoulder and having a horizontal cross-section of substantially the same shape as the skirt wherein the space between said flange and skirt is adapted to receive the top of the cup in fluid tight engagement, the inside of the skirt opposite the flange has an peripheral groove opposite the flange, and the cup has a peripheral bead adjacent its top for snap-locking engagement with the groove of the skirt and the snap-locking means adjacent the bottom of the cup comprise a peripheral groove on the inside of the skirt adjacent its bottom adapted to receive a peripheral bead adjacent the bottom of the cup.

15. The applicator of claim 12 wherein a vertical spacer rib is molded on each of the opposed sides of the cup walls toward the skirt about midway between the long axis of the ellipse and friction elements on opposite sides of the outside of the skirt form a friction area which overlie the vertical ribs of the cup.

16. The applicator of claim 12 wherein the bottom of the cup forms the bottom of the applicator and the cup is molded from high density polyethylene or polypropylene.

* * * * *